US011162337B2

(12) United States Patent
Sabatier

(10) Patent No.: US 11,162,337 B2
(45) Date of Patent: Nov. 2, 2021

(54) METHOD AND SYSTEM FOR SERVICING A WELL

(71) Applicant: 925599 ALBERTA LTD., Bonnyville (CA)

(72) Inventor: Clint Roger Sabatier, Bonnyville (CA)

(73) Assignee: 925599 Alberta Ltd., Bonnyville (CA)

( * ) Notice: Subject to any disclaimer, the term of this patent is extended or adjusted under 35 U.S.C. 154(b) by 0 days.

(21) Appl. No.: 16/823,702

(22) Filed: Mar. 19, 2020

(65) Prior Publication Data

US 2020/0217182 A1 Jul. 9, 2020

Related U.S. Application Data

(62) Division of application No. 15/085,909, filed on Mar. 30, 2016, now Pat. No. 10,677,029.

(Continued)

(51) Int. Cl.
*E21B 43/12* (2006.01)
*B05D 7/22* (2006.01)

(Continued)

(52) U.S. Cl.
CPC ..... *E21B 43/126* (2013.01); *B05D 7/222* (2013.01); *E21B 17/1007* (2013.01); *E21B 17/20* (2013.01); *E21B 37/00* (2013.01)

(58) Field of Classification Search
CPC ..... E21B 17/1007; E21B 17/20; E21B 37/00; E21B 43/126; B05D 7/222; B05D 7/225
See application file for complete search history.

(56) References Cited

U.S. PATENT DOCUMENTS 3,100,452 A 8/1963 Grimmer et al.
4,103,748 A * 8/1978 Arnold ..... E21B 7/04 166/242.4

(Continued)

FOREIGN PATENT DOCUMENTS

CA 2444086 A1 11/2002
CA 2638790 A1 11/2002

(Continued)

OTHER PUBLICATIONS

APS/ASME Tubular Sizing Chart; https://www.engineersedge.com/pipe_schedules.html Website Archive Taken from Sep. 20, 2011 (Year: 2011).*

(Continued)

*Primary Examiner* — Christopher J Sebesta
(74) *Attorney, Agent, or Firm* — Dority & Manning, P.A.

(57) ABSTRACT

A method and system for servicing a well. Servicing a well often includes running a service string into a production string, which may include a rod string. A service portion is provided in the production string during completion. The service portion is located at or uphole of a large rod string feature. The service portion has a greater inside diameter than production tubing and other standard production string components. The service portion provides sufficient clearance for the service string alongside the large feature. The large feature may be, for example, a PCP stator, a centralizer, or a rod collar. The large feature may be pulled uphole into the service portion prior to running in the service string, allowing servicing downhole of the large feature without pulling the entire rod string. The service portion may also mitigate rod wear in deviated or other portions of the well.

9 Claims, 10 Drawing Sheets

Related U.S. Application Data

(60) Provisional application No. 62/140,184, filed on Mar. 30, 2015.

(51) Int. Cl.

| | |
|---|---|
| ***E21B 17/10*** | (2006.01) |
| ***E21B 17/20*** | (2006.01) |
| *E21B 37/00* | (2006.01) |

(56) References Cited

U.S. PATENT DOCUMENTS

| | | | | |
|---|---|---|---|---|
| 4,458,404 | A * | 7/1984 | Garrett | B29C 66/1122 228/175 |
| 5,259,457 | A * | 11/1993 | Williamson, Jr. | E21B 34/10 166/321 |
| 6,510,896 | B2 | 1/2003 | Bode et al. | |
| 6,623,252 | B2 | 9/2003 | Cunningham | |
| 6,832,649 | B2 | 12/2004 | Bode et al. | |
| 7,201,222 | B2 | 4/2007 | Kanady et al. | |
| 7,735,557 | B2 | 6/2010 | Mailand et al. | |
| 7,905,714 | B2 | 3/2011 | Gerling | |
| 8,006,769 | B2 | 8/2011 | Chambers, II et al. | |
| 8,376,053 | B2 | 2/2013 | Obrejanu | |
| 8,376,055 | B2 | 2/2013 | Chambers, II et al. | |
| 8,985,226 | B2 | 3/2015 | Head | |
| 2009/0136371 | A1* | 5/2009 | Gerling | F04C 2/1073 418/48 |
| 2011/0243774 | A1 | 10/2011 | Underwood et al. | |
| 2011/0266005 | A1 | 11/2011 | Hult et al. | |
| 2013/0175048 | A1 | 7/2013 | Goode et al. | |
| 2013/0180730 | A1* | 7/2013 | Bebak | E21B 43/128 166/381 |
| 2014/0332275 | A1* | 11/2014 | Murray | F04C 13/008 175/57 |

FOREIGN PATENT DOCUMENTS

| | | | | |
|---|---|---|---|---|
| CA | 2707740 | A1 | 11/2002 | |
| CA | 2655501 | A1 | 1/2008 | |
| CA | 2751152 | A1 | 8/2010 | |
| CA | 2738500 | A1 | 10/2011 | |
| CA | 2794501 | A1 | 10/2011 | |
| CA | 2855724 | A1 | 5/2013 | |
| CS | 2672137 | * | 1/2011 | E21B 43/12 |
| GB | 764561 | A | 12/1956 | |
| WO | 2008083522 | A1 | 7/2008 | |

OTHER PUBLICATIONS

Artificial Lift, Root Size Chart, Completion & Productive Solutions, Dec. 9, 2014, 3 pages.

Artificial Lift Systems Catalogue, Evolution Oil Tools inc, Jun. 2011, 45 pages.

International standards for tubing, Retrieved from http://petrowiki.org/international_standards_for_tubing, Retrieved on Apr. 15, 2015, 4 pages.

MAC-100Cc, Inventors in Metallic Protective Coatings, Prime Coating Systems, published before Mar. 19, 2020, pages.

MAC-200Wc, Inventors in Metallic Protective Coatings, Prime Coating Systems, published before Mar. 19, 2020, 1 page.

Mantl Root Chart, Progressing Cavity Pump Technical Specifications, published before Mar. 19, 2020, 2 pages.

Norris Productive Solution, Oil Lift Technology Inc, published before Mar. 19, 2020, 8 pages.

Progressing Cavity Pumps, Completion and Productive Solutions, published before Mar. 19, 2020, 4 pages.

Progressing Cavity Pumps, Oil Lift Technology Inc, published before Mar. 19, 2020, 36 pages.

SHUR-FLO Tubular Lining, PAT 82706, Pipe (2015) inc, Mar. 28, 2016, 4 pages.

Sucker Rod Guided, Weatherford, 2014, 12 pages.

T2 Artificial Life Systems—PC Pump Spec Sheet, Artificial Life System ltd, published before Mar. 19, 2020, 1 page.

* cited by examiner

METHOD AND SYSTEM FOR SERVICING A WELL

CROSS REFERENCE TO RELATED APPLICATIONS

This application is a divisional of U.S. patent application Ser. No. 15/085,909, filed Mar. 30, 2016, which claims the benefit of priority of U.S. Provisional Patent Application No. 62/140,184, filed Mar. 30, 2015. Both of these prior patent applications are herein incorporated by reference in their entirety.

FIELD

The present disclosure relates generally to well servicing that includes running a service string into a production string.

BACKGROUND

When producing hydrocarbons or other fluids from an underground formation, a string of production tubing is typically run into the reservoir to provide a conduit to the surface for the produced fluids. Depending on the type of artificial lift applied to the formation, a rod string will often be located within the production string. Some types of servicing include running coiled tubing into the production string, in some cases to the bottom of the well.

A progressive cavity pump (a "PCP") is an example of a commonly-used artificial lift apparatus for producing hydrocarbons or other fluids from underground reservoirs. A PCP includes a helical rotor/stator pair with corresponding surfaces to advance a cavity between the rotor and the stator uphole when the rotor is rotated relative to the stator. The stator is located at the end of the production tubing and the rotor is located within the stator at the downhole end of the rod string. Where a PCP is used to produce fluids from reservoirs including a significant amount of debris, the PCP may become blocked by the debris. When this occurs, the PCP must be serviced, which necessarily interrupts production. Greater complexity in servicing the PCP will typically lead to longer processes for servicing the PCP and correspondingly greater delay costs.

In some heavy oil reservoirs, a PCP may become clogged with sand, or "sanded off" during production. Standard practice is to apply a process including pulling the entire rod string including the PCP rotor, running coiled tubing into the production string to the stator, cleaning the stator, pulling the coiled tubing, running the rod string back into the production string to secure the rotor within the stator, and resuming production. This process often results in significant interruption of production and associated costs.

It is, therefore, desirable to provide an approach to cleaning a PCP or other downhole servicing which results in lowered costs associated with previous approaches.

SUMMARY

It is an object of the present disclosure to obviate or mitigate at least one disadvantage of previous approaches to servicing a production string having a rod string therein (e.g. servicing a stator on a downhole progressive cavity pump ["PCP"], etc.). Standard production tubing often lacks sufficient inside diameter to accommodate a large feature of a rod string (e.g. a PCP rotor, a rod centralizer, a rod collar, etc.) side-by-side with a service string (e.g. coiled tubing, etc.) used to service a target portion of the production string (e.g. when using coiled tubing for delivering fluids to a PCP stator for cleaning, etc.).

The present disclosure provides methods and systems for servicing a downhole target portion of a production string with a service string where the production string includes a rod string having at least one large feature uphole of the target portion. The large feature may occupy a sufficient portion of the production string inside diameter to prevent easy passage of the service string within the production tubing past the large feature. The present disclosure facilitates such servicing by providing a service portion within the production string uphole of the large feature. The service portion provides sufficient clearance between the large feature and an inside diameter of the service portion of the production string to run a service string through the production string alongside the large feature, removing the requirement to pull the entire rod string before running the service string. An increased inner diameter to provide such clearance is present along the length of a service portion of the production string, which is at least as long as the large feature.

The service portion may be provided by a service tool included in the production string uphole of the large feature. The service tool has a length and inside diameter selected with reference to the large feature, and an outside diameter selected with reference to the outside diameter of a selected portion of the tubing string (e.g. production tubing, connectors for production tubing, etc.) and the inside diameter of casing or a wellbore. The length of the service tool is sufficient to accommodate the entire length of the large feature. The inside diameter is sufficient to accommodate the large feature and the service string. The outside diameter is selected to fit within the narrowest portion of the wellbore and may be approximately equal to the largest outside diameter of the production string (e.g. the outside diameter of couplings where tubing joints are used to prepare the production string, etc.). Relative to the production tubing, the service tool has a larger inside diameter along the service portion. At each end of the service tool, the inside diameter may be reduced to that of the majority of the production string for providing a threaded connection compatible with a collar, production tubing joint, or other connection point with the production string.

When the target portion is to be serviced, the rod string may be pulled a distance of about the length of the large feature. By pulling the rod string uphole by about the length of the large feature and maintaining that position, the entire length of the large feature may be located within the service tool, as opposed to within conventional production tubing making up the bulk of the production string. The inside diameter of the service tool is sufficient to accommodate the large feature and the service string, allowing the service string to be run in the production tubing, through the service tool alongside the large feature, and to the downhole feature.

For example, the methods and systems disclosed herein may be applied to servicing a PCP stator located downhole near or at the end of a production string. A PCP rotor is within the PCP stator at the downhole end of a rod string. A major diameter of the PCP rotor is often sufficiently large that coiled tubing will not fit within the production string alongside the PCP rotor. Previous approaches to servicing a PCP stator with coiled tubing typically include pulling the entire rod string to provide sufficient clearance to run the coiled tubing downhole to the PCP stator. The methods and systems provided herein facilitate servicing the PCP stator without pulling the entire rod string. Instead, the rod string may be pulled the length of the PCP rotor to locate the entire length of the PCP rotor within the service tool, and the coiled tubing then run through the production tubing and the service tool to the PCP stator. The additional clearance provided within the service tool allows the coiled tubing to pass the PCP rotor and reach the PCP stator.

The methods and systems disclosed herein may also mitigate rod wear on the production string. The increased inside diameter of the service portion results in exposure to less pressure from a rod that is abutting the service portion than would be the case at the inside diameter of the production string. Damage to the service tool or other tubular used to provide the service portion may be mitigated by including a hardened coating on the inside surface at the service portion or otherwise hardening the inside surface. Damage to both the rod and to the service tool or other tubular may be mitigated by including a reduced friction insert or otherwise softening the inside surface.

In a first aspect, the present disclosure provides a method and system for servicing a well. Servicing a well often includes running a service string into a production string, which may include a rod string. A service portion is provided in the production string during completion. The service portion is located at or uphole of a large rod string feature. The service portion has a greater inside diameter than production tubing and other standard production string components. The service portion provides sufficient clearance for the service string alongside the large feature. The large feature may be, for example, a PCP stator, a centralizer, or a rod collar. The large feature may be pulled uphole into the service portion prior to running in the service string, allowing servicing downhole of the large feature without pulling the entire rod string. The service portion may also mitigate rod wear in deviated or other portions of the well.

In a further aspect, the present disclosure provides a method of completing a well including: providing a production string extending between a downhole end and an uphole end, the production string for use with a rod string including a large feature; and providing a service portion of the production string intermediate the uphole end and a large feature location of the production string, the large feature being located in the large feature location when the rod string is in a production position. The service portion has a service length sufficient to accommodate the large feature. The service portion has a service inside diameter ("ID") sufficient to accommodate the large feature and a service string.

In some embodiments, the service portion is proximately uphole of the large feature location.

In some embodiments, the large feature comprises a PCP rotor and the large feature location comprises a PCP stator. In some embodiments, the service portion is immediately uphole of the PCP stator.

In some embodiments, the large feature comprises a rod string collar.

In some embodiments, the service string comprises coiled tubing.

In some embodiments, the service portion comprises a service tool. In some embodiments, providing the service portion comprises connecting the service tool with the production string uphole of the large feature location.

In some embodiments, the production string comprises tubing joints having a tubing outside diameter ("OD") and a tubing ID, and collars connecting the joints, the collars having a collar OD. In some embodiments, the tubing OD is about 3.5"; the tubing ID is about 3.0"; the collar OD is about 4.5"; the service ID is at least 3.5"; and the service portion has an OD of about 4.5". In some embodiments, the service ID is about 3.8".

In some embodiments, the production string comprises tubing joints having a tubing outside diameter ("OD") and a tubing ID, and collars connecting the joints, the collars having a collar OD. In some embodiments, the tubing OD is about 4.5"; the tubing ID is about 4.0"; the collar OD is about 5.5"; the service ID is about 4.5"; and the service portion has an OD of about 5.5".

In a further aspect, the present disclosure provides a method of servicing a target portion of a production string, the target portion being downhole of a large feature of a rod string within the production string. The method includes: pulling the rod string by at a distance of at least the length of the large feature for locating the large feature in a service portion of the production string uphole of a production position of the large feature, the service portion having a service length sufficient to accommodate the large feature and a service inside diameter ("ID") sufficient to accommodate the large feature alongside a service string; and running the service string into the production string, past the large feature in the service portion, and to the target portion.

In some embodiments, the large feature comprises a PCP rotor and the production position of the PCP rotor is within a PCP stator located downhole of the service portion. In some embodiments, the target portion comprises the PCP stator.

In some embodiments, the large feature comprises a rod string collar.

In some embodiments, the service portion comprises a service tool.

In some embodiments, the service string comprises coiled tubing.

In some embodiments, the production string comprises tubing joints having a tubing outside diameter ("OD") and a tubing ID, and collars connecting the joints, the collars having a collar OD. In some embodiments, the tubing OD is about 3.5"; the tubing ID is about 3.0"; the collar OD is about 4.5"; the service ID is at least 3.5"; and the service portion has an OD of about 4.5". In some embodiments, the service ID is about 3.8"; in some embodiments, the service string has an OD of about 0.75"; in some embodiments, the large feature comprises a PCP rotor with a major dimension of about 2.75".

In some embodiments, the production string comprises tubing joints having a tubing outside diameter ("OD") and a tubing ID, and collars connecting the joints, the collars having a collar OD. In some embodiments, the tubing OD is about 4.5"; the tubing ID is about 4.0"; the collar OD is about 5.5"; the service ID is about 4.5"; and the service portion has an OD of about 5.5". In some embodiments, the service string has an OD of about 0.75"; in some embodiments, the large feature comprises a PCP rotor with a major dimension of about 3.75".

In a further aspect, the present disclosure provides a method of completing a well comprising: providing a production string extending between a downhole end and an uphole end; and providing an increased inside diameter ("ID") portion of the production string at a selected location in the production string for mitigating rod wear on the production string at the selected location caused by a rod string located within the production string. The increased ID portion providing a correspondingly increased clearance between an ID surface of the production string and an outside diameter ("OD") surface of the rod string at the increased ID portion, the increased clearance being greater than between the OD surface of the rod string and portions of the production string other than the increased ID portion.

In some embodiments, the selected location is in a deviated portion of the wellbore.

In some embodiments, the selected location is in a heel of the wellbore.

In some embodiments, the large inside diameter portion of the production string has a hardness of about 80 Rockwell C. In some embodiments, the large inside diameter portion of the production string is hardened by boranizing or applying a coating to the large inside diameter portion.

In some embodiments, the production string comprises a low wear insert along at least a portion of the large inside diameter portion of the production string.

In some embodiments, the production string other than the large diameter portion comprises joints of production tubing and collars connecting the joints.

In some embodiments, the production tubing has an OD of about 3.5"; the production tubing has an ID of about 3.0"; the collars have an OD of about 4.5"; the increased ID portion has an ID of about 3.5"; and the increased ID portion has an OD of about 4.5".

In some embodiments, the production tubing has an OD of about 4.5"; the production tubing has an ID of about 4.0"; the collars have an OD of about 5.5"; the increased ID portion has an ID of about 4.5"; and the increased ID portion has an OD of about 5.5".

In a further aspect, the present disclosure provides a service tool for use in a production string with a rod string received therein, the service tool comprising: a body extending between a pair of production string connection portions; a bore extending through the body between the production string connection portions; a service portion of the bore extending along the body for a service length, the bore having a service inside diameter ("ID") at the service portion; and production threading on the connection portions for connecting the service tool with the production string. The service length is sufficient to accommodate a selected large feature of the rod string. The service ID is sufficient to accommodate the large feature and a service string. A tool outside diameter ("OD") of the body and the pair of production string connection portions is equal to or less than the OD of other components of the production string.

In some embodiments, the large feature comprises a PCP rotor and the service string comprises a coiled tubing string.

In some embodiments, the production string comprises joints of production tubing connected with production tubing collars, and the tool OD is equal to about the OD of the production tubing collars.

In some embodiments, the production string comprises joints of production tubing connected with at box ends, and the tool OD is equal to about the OD of the box ends.

In some embodiments, the service ID is about 3.5" and the production threading comprises API interference fit threading for 3.5" outside diameter production tubing. In some embodiments, the inside diameter is about 4.5" and the production comprises API interference fit threading for 4.5" outside diameter production tubing. In some embodiments, the service tool has an outside diameter of about 5.5".

In some embodiments, the production string connection portions are each integrally formed portions of the body.

In some embodiments, the service tool includes a pair of connection adapters connected at opposed ends of the body, and wherein the production string connection portions are located on the connection adapters. In some embodiments, the connection adapters are connected with the body by a service threading, the service threading being incompatible with the production threading. In some embodiments, each of the connection adapters comprises a production end ID equal to about an ID of the production string, and at least a portion of the connection adapter with the production end ID is coextensive with the production string connection portion on the connection adapter. In some embodiments, each of the connection adapters comprises an adapter end ID equal to about the service ID, and at least a portion of the connection adapter with the adapter end ID is coextensive with a portion of the connection adapter including the service threading for connection to the body.

In some embodiments, the service tool includes a pair of connection adapters connected at opposed ends of the body, and wherein the production string connection portions are located on the connection adapters. In some embodiments, the service portion extends along the body and at least a portion of each of the connection adapters; in some embodiments, the connection adapters are connected at opposed ends of the body at box ends defined on the body and pin ends defined on the connection adapters.

In some embodiments, the body comprises two or more sub-assemblies, each of the two or more sub-assemblies connected with each other by a sub connector, and the service portion extending across the two or more sub-assemblies connected and a corresponding number of sub connectors.

In some embodiments, at least one of the production string connection portions comprises a pin end.

In some embodiments, at least one of the production string connection portions comprises a box end.

In a further aspect, the present disclosure provides a method of completing a well including: connecting a PCP stator with a service tool; and connecting a production string extending between a downhole end of the well and an uphole end of the well with the service tool for locating the service tool intermediate the PCP stator and the uphole end of the wellbore. The service tool has a service length sufficient to accommodate a PCP rotor for use with the PCP stator. The service tool has a service inside diameter ("ID") sufficient to accommodate the PCP rotor and a service string.

In some embodiments, connecting the service tool with the production string comprises connecting the service tool with the downhole end of a production string as the stator, service tool, and production string are run into the well.

In some embodiments, the service string comprises coiled tubing.

In some embodiments, the service tool comprises a body connected with a pair of connection adapters, the connection adapters including production threading for connecting with the production tubing string and with the PCP stator. In some embodiments, the connection adapters are connected with the body by a service threading, the service threading being incompatible with the production threading; each of the connection adapters comprises a production end ID equal to about an ID of the production string, and at least a portion of the connection adapter with the production end ID is coextensive with the production string connection portion on the connection adapter; and each of the connection adapters comprises an adapter end ID equal to about the service ID, and at least a portion of the connection adapter with the adapter end ID is coextensive with a portion of the connection adapter including the service threading for connection to the body In a further aspect, the present disclosure provides a method of servicing a PCP stator located proximate a downhole end of a production string, the PCP stator having a PCP rotor therein, the PCP rotor located proximate a downhole end of a rod string, and the method comprising: pulling the rod string by at least about the length of the PCP rotor to remove the PCP rotor from the PCP stator, locating the PCP rotor in a service portion of the production string, the service portion of the production string having a service inside diameter ("ID") sufficient to accommodate the PCP rotor and a service string; and running the service string into the production string, past the PCP rotor in the service portion, and to the PCP stator.

In some embodiments, the service string comprises coiled tubing.

In some embodiments, the service portion of the production string comprises a service tool located uphole of the PCP stator.

In some embodiments, pulling the rod string by at least about the length of the PCP rotor comprises pulling the rod string by about the length of the PCP rotor.

Other aspects and features of the present disclosure will become apparent to those ordinarily skilled in the art upon review of the following description of specific embodiments in conjunction with the accompanying figures.

BRIEF DESCRIPTION OF THE DRAWINGS

Embodiments of the present disclosure will now be described, by way of example only, with reference to the attached figures, in which features sharing reference numerals with a common final two digits of a reference numeral correspond to similar features across multiple figures (e.g. the service tool 10, 110, 210, 310, 410, 510, 610, 710, 810, 910, 1010, 1110, etc.).

DETAILED DESCRIPTION

Figure 1:
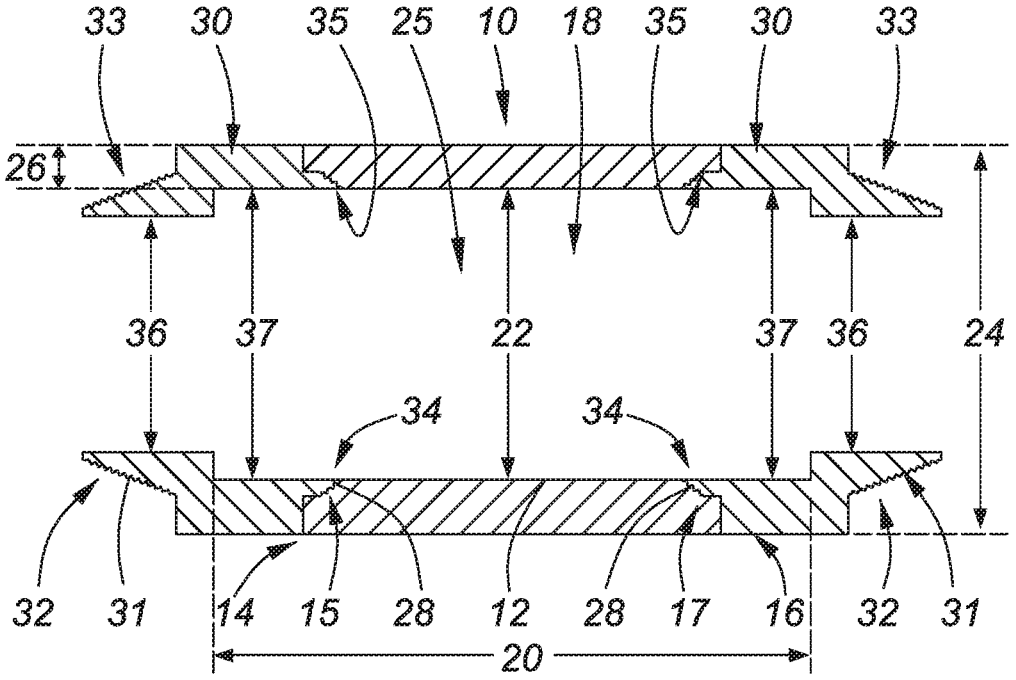
PRIOR ART FIG. 1
FIG. 1 is a cross-section elevation view of a service tool.

Generally, the present disclosure provides methods and systems for servicing a downhole target portion of a production string having a rod string therein using a service string. The methods and systems provided herein facilitate running a service string downhole past a large feature of the rod string, the large feature occupying a sufficiently large portion of the production tubing's cross-sectional area to complicate or prevent passage of the service string past the large feature within the production tubing.

The methods and systems disclosed herein may be applied to servicing a stator of a progressive cavity pump (a "PCP") using coiled tubing, in which case the target portion of the production string is a PCP stator, the service string is coiled tubing, and the large feature is a PCP rotor pulled from the PCP stator. In typical production tubing, a major diameter of the PCP rotor is sufficiently large to complicate or prevent passage of coiled tubing.

When producing fluids from an underground formation, the PCP may be located at or near the end of a string of production tubing run into the reservoir to provide artificial lift for producing the fluids. Where the fluid is a heavy oil or other viscous hydrocarbon, PCPs may be a common choice for an artificial lift solution. A PCP may be common choice in a reservoir known to include heavy hydrocarbons with a large amount of particulate debris (e.g. sand, etc.). During use in such reservoirs, the PCP may become clogged with debris, or "sanded off", which may be corrected by servicing. Such servicing may be provided by delivery of fluids to the PCP stator from coiled tubing for cleaning the PCP stator.

The PCP stator may be located at the downhole end of the production string. The helical PCP rotor may be located at the downhole end of the rod string. The rod string is received within the production string. A helical stator cavity is defined within the PCP stator. A helix of the PCP rotor corresponds to a helix of the stator cavity and the rotor is received within the stator cavity. The outside surface of the PCP rotor and the inside surface of the stator cavity are correspondingly shaped to advance a cavity defined between the PCP rotor and the PCP stator uphole when the rotor is rotated relative to the stator.

Pulling the PCP rotor from the PCP stator may be necessary to service the PCP stator. In many such cases, the entire rod string is pulled. Where the PCP is sanded off or otherwise plugged with particulate debris, coiled tubing may be used to deliver fluids to the PCP stator for cleaning, and the entire rod string may be pulled to allow the coiled tubing to be run in to the PCP stator. The entire rod string is pulled where the inside diameter of production tubing does not accommodate both the PCP rotor and the coiled tubing. This is often the case with standard production tubing as the rotor is often the portion of the rod string with the greatest outside diameter. In particular, servicing a PCP stator on a production string prepared from production tubing having an outside diameter of 4.5" or 3.5" may require pulling the entire rod string to allow ¾" coiled tubing to be run in to the PCP stator. Similarly, servicing a PCP stator on a production string prepared from production tubing having an outside diameter of 2.375" or 2.875" may require pulling the entire rod string to allow ½" coiled tubing to be run in to the PCP stator. This is illustrated by the features of standard API interference-fit threaded production tubing shown in Table 1 (with acronyms for outside diameter "OD", inside diameter "ID", and major dimension diameter "MD" used in Table 1):

TABLE 1

Dimensions of API interference-fit threaded tubing, PCP rotors, and coiled tubing

| Tubing OD | Collar OD | Tubing ID | PCP Rotor MD | Coil OD |
|---|---|---|---|---|
| 2.375" | 3.063" | 1.995" | 1.625" | 0.50" |
| 2.875" | 3.668" | 2.441" | 2.297" | 0.50" |
| 3.5" | 4.5" | 3" | 2.75" | 0.75" |
| 4.5" | 5.5" | 3.958" | 3.00 to 3.75" | 0.75" |

As shown above, coiled tubing having an outside diameter of 0.75" will not clear a PCP rotor in 3.5" API interference fit threaded tubing (4.5" outside diameter collars). In 4.5" API interference fit threaded tubing (5.5" outside diameter collars), coiled tubing with an outside diameter of 0.75" will have less than 0.25" of clearance with smaller PCP rotors (e.g. 3.00", etc.), and will not clear the larger PCP rotors (e.g. 3.75", etc.). For a given production tubing outside diameter, such as 4.5", a PCP rotor having a larger major diameter, such as 3.75", will provide a greater flow rate than a PCP rotor having a smaller major diameter, such as 3.00".

Methods and systems described herein may facilitate servicing a PCP stator with coiled tubing without pulling the entire rod string before servicing. A service portion is included in the production string uphole of the PCP stator. The service portion has a length sufficient to accommodate the length of the PCP rotor and an inside diameter sufficient to accommodate the major diameter of the PCP rotor and a coiled tubing string. To service the PCP stator with the coiled tubing, the rotor is pulled uphole into the service portion. The coiled tubing may be run in through the service tool with the PCP rotor received within the service portion, facilitating access to the PCP stator by the coiled tubing. The service portion may be defined within a service tool located in the production string.

Servicing a PCP stator with coiled tubing is a particular application of the methods and systems disclosed herein. However, as is implicit by the exemplary nature of such application to a PCP stator using coiled tubing, the methods and systems disclosed herein apply more generally.

The methods and systems disclosed herein facilitate using a service string to service a downhole target portion of a production string having a large feature located on a rod string uphole of the target portion, wherein the tubing making up the production string has an insufficient inside diameter to accommodate both the service string and the large feature. The methods and systems disclosed herein include providing a greater inside diameter along the production string uphole of the large feature, accommodating the large feature and the service string along at least a portion of the production string to allow the service string access to the production string downhole from the large feature without pulling the entire rod string.

The service portion may be provided within a service tool located in the production string uphole of the large feature. The rod string need be pulled only by the distance required to locate the large feature within the greater diameter portion of the production string. The closer the service tool is to the production position of the large feature, the shorter the distance that the rod string would be pulled uphole by to facilitate servicing the production string at the target portion. Where the service tool is proximately or immediately uphole of the production position, the distance that the large feature would be pulled uphole to locate it within the service tool is less than where the service tool is distally uphole of the production position, but may still result in less effort and rig time than pulling the entire rod string.

The methods and systems disclosed herein also have application to providing additional inside diameter in portions of a production string which have a greater risk of rod wear, such as in a heel of a horizontal wellbore or in a deviated portion of a wellbore (horizontal or vertical).

Service Tool

FIG. 1 is a schematic of a service tool 10. The service tool 10 includes a body 12 connected with a pair of connection adapters 30. A bore 18 is defined within and extends through the body 12 and through the connection adapters 30. The bore 18 would be in communication with a bore of any tubular connected with the service tool 10 at the connection adapters 30 (e.g. production tubing joints, a production tubing collar, a PCP stator, etc.) as shown below with reference to FIGS. 2 to 5.

A service portion 25 of the bore 18 extends along a service length 20 of the service tool 10. The service length 20 may extend along the body 12 and a portion of each connection adapter 30. In the service portion 25 along the service length 20, the bore 18 has a service inside diameter 22. The service length 20 is sufficient to accommodate the entire length of a selected large feature of a rod string (e.g. a PCP rotor, a rod centralizer, a rod collar, etc.) within the bore 18 having the service inside diameter 22. The service inside diameter 22 may be selected with reference to an outside diameter of the large feature. The service inside diameter 22 is sufficient to accommodate the large feature and a service string (e.g. a coiled tubing string, etc.) within the bore 18.

The service tool 10 defines a maximum outside diameter 24 selected with reference to features of a production string with which the service tool 10 is intended to be used. The maximum outside diameter 24 may be the outside diameter of the majority of the body 12 and of the connection adapters 30 as shown in FIG. 1. The outside diameter 24 may be selected to the be no greater than a selected outside diameter of a production string with which the service tool 10 will be used (e.g. the outside diameter of production tubing connectors, of other portions of the production string with a large outside diameter, etc.).

Along the service portion 25, the body 12 defines a body wall thickness 26 and the connection adapter 30 defines an adapter wall thickness 39. The maximum outside diameter 24, the body wall thickness 26, and the adapter wall thickness 39 may define constraints on maximizing the service inside diameter 22.

Service Tool in Production String Uphole of PCP Stator

Figure 2:
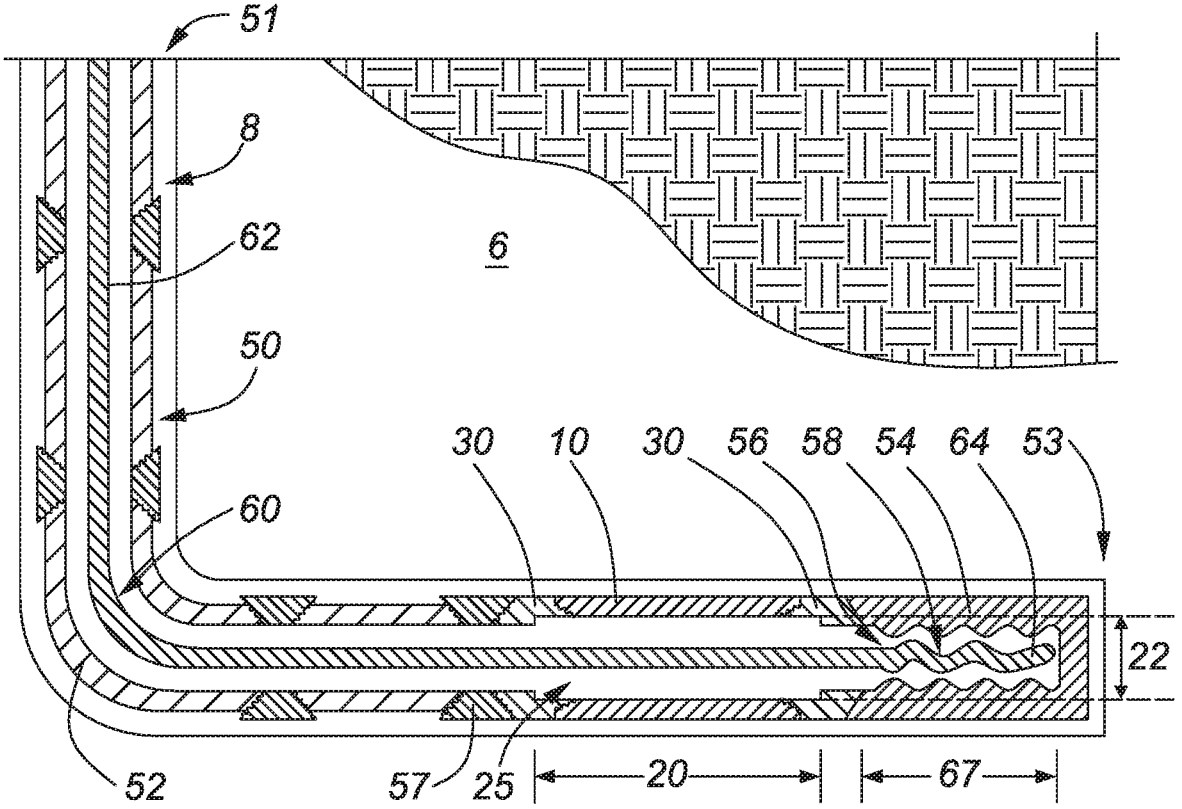
FIG. 2 is a cross-section elevation view of the service tool of FIG. 1 in a production string.

FIG. 2 shows the service tool 10 located in a production string 50 in a wellbore 8 drilled into a hydrocarbon reservoir 6 during production of hydrocarbons from the hydrocarbon reservoir 6. The production string 50 extends between an uphole end 51 and a downhole end 53. The production string 50 may include production tubing, shown as pin-pin tubing joints 52 assembled with tubing collars 57 between the uphole end 51 and the service tool 10. Any suitable production tubing may be applied (e.g. box-pin tubing joints assembled into a string, coiled production tubing, etc.). The service tool 10 is connected with the tubing collar 57 and with a PCP stator 54 by a pair of connection adapters 30, which are in turn connected to a body 12. The service length 22 and the service portion 25 extend along the bore 18 through the body 12 and both connection adapters 30. The PCP stator 54 defines a helical cavity 56 therein.

The PCP stator 54 may be located at or proximate the downhole end 53 of the production string 50. Alternatively, multiple PCP stators may be located in series on the production string, with a service tool uphole of each PCP stator (e.g. where a charge PCP is used in addition to a production PCP, where two production PCPs are applied, etc.). In addition, the presence of a rod collar on the rod string 60 may also benefit from locating a short service tool 10 uphole of the rod collars. The rod collars may be an example of the large feature 265 of the rod string 260 in FIGS. 9 and 10, or the large feature 365 of the rod string 360 in FIG. 11.

A rod string 60 is located within the production string 50. The rod string 60 extends between an uphole end 61 and a downhole end 63. A rod 62 (e.g. rod joints connected with each other, a continuous rod, etc.) extends between the uphole end 61 and a PCP rotor 64 at or proximate the downhole end 63. The PCP rotor 64 is located within the helical cavity 56, defining a progressing cavity 58 between the PCP stator 54 and the PCP rotor 64. When the PCP rotor 64 is rotated relative to the PCP stator 54, the progressing cavity 58 advances uphole, providing artificial lift. Where multiple PCP stators are located in series on the production string, corresponding multiple PCP rotors are also located on the production string (not shown). The PCP rotor extends along the rod string 60 for a PCP rotor length 67 and has a major diameter 68 along the PCP rotor length 67.

Figure 3:
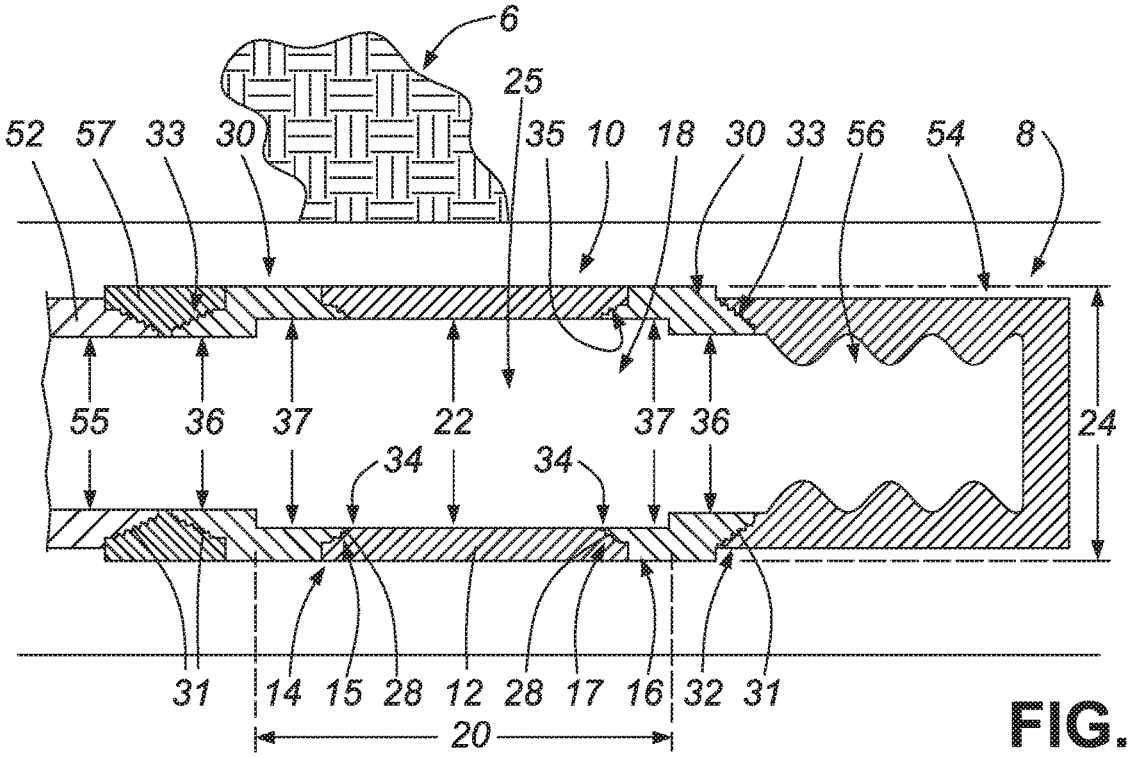
FIG. 3 is a detail view of the production string of FIG. 2 with a PCP rotor pulled uphole.
Figure 4:
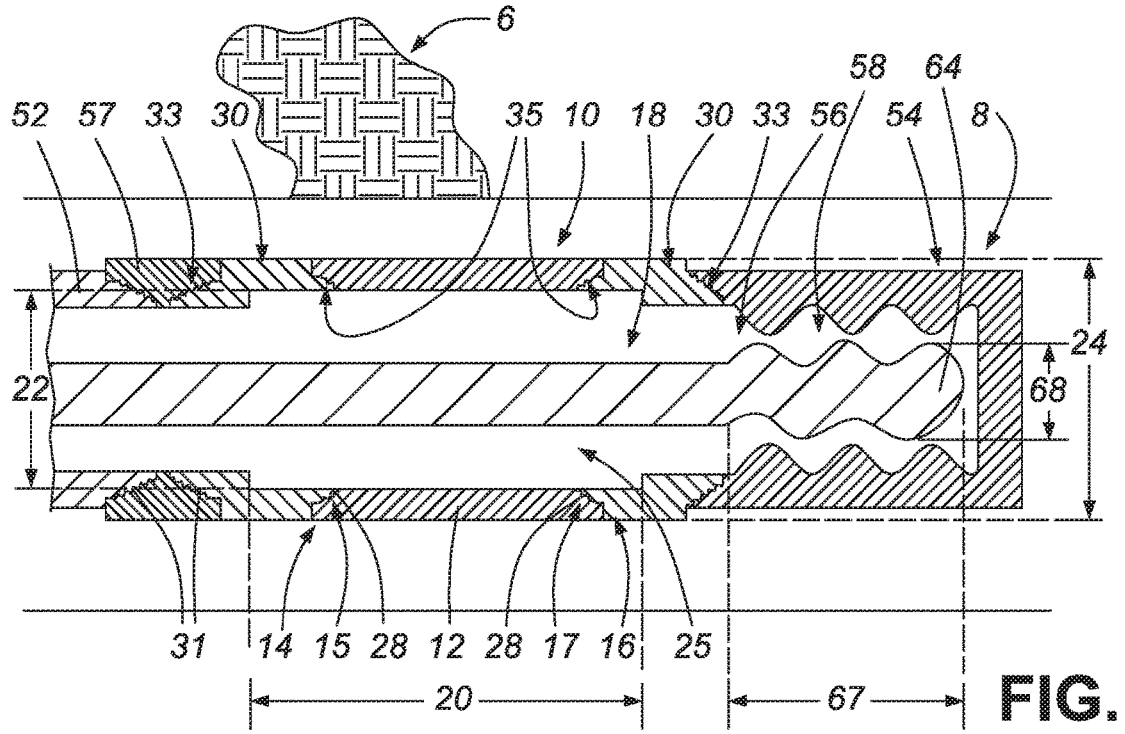
FIG. 4 is a cross-section elevation view of the production string of FIG. 2 with a PCP rotor in a production position.

FIGS. 3 and 4 respectively show a detail view of the production string 50 with the PCP rotor 64 pulled uphole beyond the tubing collar 57 connected with the service tool 10, and with the PCP stator 54 in a production position.

Figure 5:
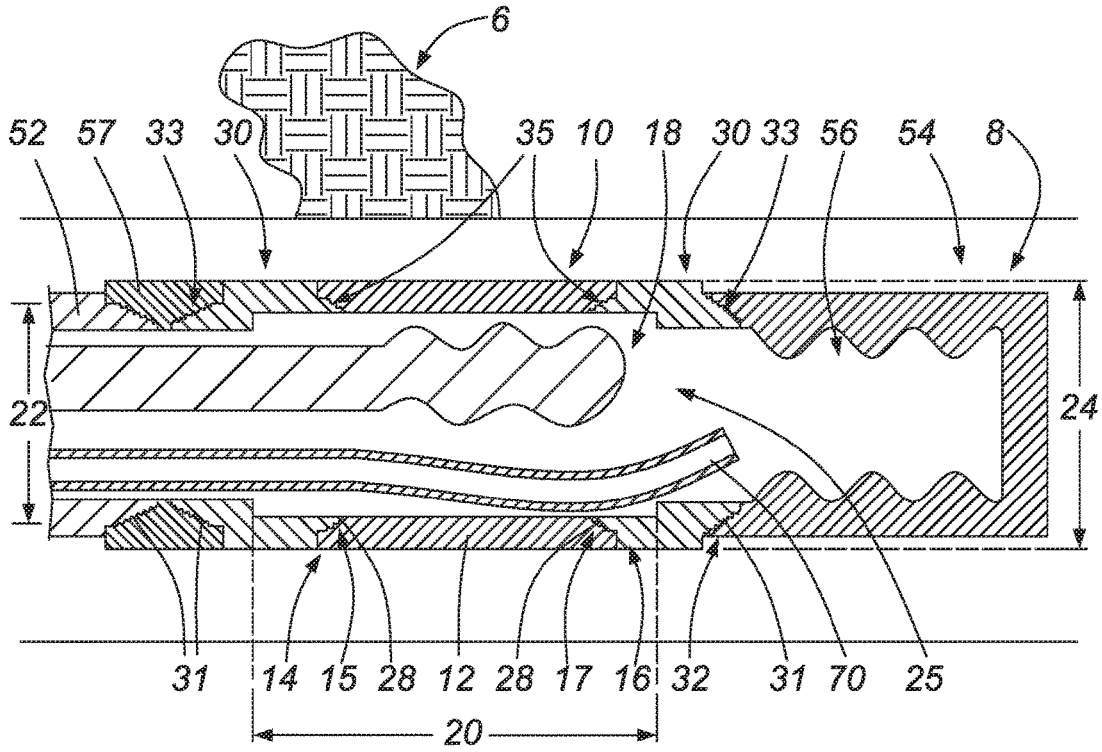
FIG. 5 is a cross-section elevation view of the production string of FIG. 2 with a PCP rotor pulled uphole into the service tool and a coiled tubing passing the PCP rotor.
Figure 6:
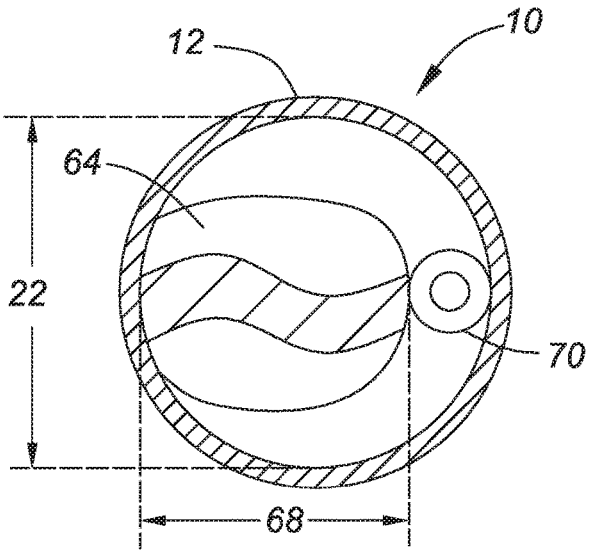
FIG. 6 is a cross-section plan view of the service tool of FIG. 2 with the PCP rotor pulled uphole into the service tool and the coiled tubing passing the PCP rotor.

FIGS. 5 and 6 show a portion of the production string 50 during servicing of the PCP stator 54 with a coiled tubing string 70 run into the production string 50 alongside the rod string 60. The rod string 60 has been pulled by about the PCP rotor length 67, locating the PCP rotor 64 within the service tool 10 and leaving the PCP stator 54 empty for servicing. The coiled tubing string 70 passes by the PCP rotor 64 in the service tool 10, where the service inside diameter 22 is sufficient to accommodate both the coiled tubing string 70 and the PCP rotor 64 at its major dimension 68.

Figure 7:
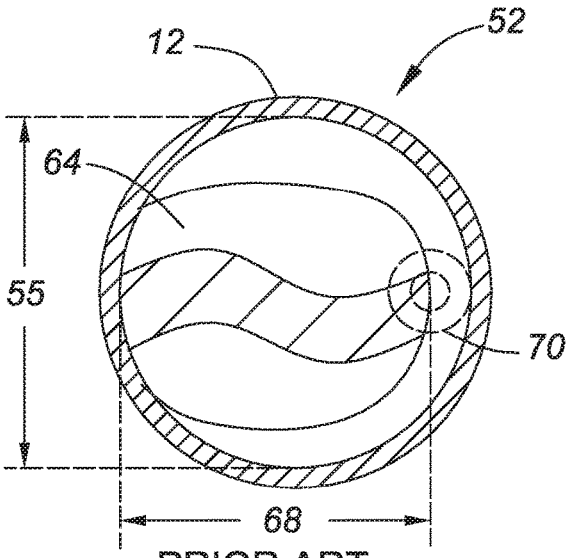
PRIOR ART FIG. 7
FIG. 7 is a cross-section plan view of a PCP rotor pulled uphole into standard production tubing.

FIG. 7 shows the PCP rotor 64 pulled into production tubing 52 having a production string inside diameter 55. The coiled tubing string 70 is shown in outline, illustrating the lack of clearance for coiled tubing to pass the PCP rotor 64 within the production tubing 52. In contrast to the service inside diameter 22, the production string inside diameter 55 is too small to accommodate both the coiled tubing string 70 and the PCP rotor 64.

Some features of a service tool 10 for use with standard API interference fit threaded tubing (having outside diameters of 2.375", 3.875", 3.5", and 4.5") are shown in Table 2 alongside the PCP rotor MD and Coil OD (with the same acronyms as Table 1):

TABLE 2

Dimensions of service tool, corresponding tubing, PCP rotors, and coiled tubing

| Tubing OD | Tool OD | Tool ID | PCP Rotor MD | Coil OD |
|---|---|---|---|---|
| 2.375" | 3.25" | 2.75" | 1.625" | 0.50" |
| 2.875" | 4.0" | 3.25" | 2.297" | 0.50" |

TABLE 2-continued

Dimensions of service tool, corresponding tubing, PCP rotors, and coiled tubing

| Tubing OD | Tool OD | Tool ID | PCP Rotor MD | Coil OD |
|---|---|---|---|---|
| 3.5" | 4.5" | 3.5" | 2.75" | 0.75" |
| 3.5" | 4.5" | 3.826" | 2.75" | 0.75" |
| 4.5" | 5.5" | 4.5" | 3.00 to 3.75" | 0.75" |

As shown above, coiled tubing having an outside diameter of 0.75" will clear a PCP rotor in a service tool designed for use with 3.5" outside diameter API interference fit threaded tubing (4.5" outside diameter collars). In 4.5" outside diameter API interference fit threaded tubing (5.5" outside diameter collars), coiled tubing have an outside diameter of 0.75" will clear a PCP rotor having a major dimension of up to 3.75". The service portion 25 would have a service portion length 20 at least as long as the PCP rotors. Some PCP rotors may be between about 20 and 30 feet long.

Connections

The bore 18 may be in communication with the production string 50 by connecting the service tool 10 with API interference fit or other standardized production tubing threaded collars or other box ends at the pin-end connection adapters 30. When the service tool 10 is assembled and ready for connection with the production string 50, the body 12 is connected with the pair of connection adapters 30.

The body 12 extends between a first end 14 and a second end 16. A first connection portion 15 of the body 12 is proximate the first end 14 and a second connection portion 17 of the body 12 is proximate the second end 16. The first and second connection portions 15, 17 facilitate connecting the body 12 with the connection adapters 30.

The service tool 10 provides sufficient clearance for the coiled tubing string 70 and the PCP rotor 64 or other large feature by maintaining the service inside diameter 22 along the service length 20, with the service length 20 being at least as great as the PCP rotor length 67 or other large feature length. As a result, the first and second connection portions 15, 17 may be designed to facilitate maximizing the body wall thickness 26 along the connection portions 15, 17 while maintaining the service inside diameter 22. In the service tool 10, each of the first and second connection portions 15, 17 defines a threaded box end for connecting with a corresponding pin end. Box ends on the service tool 10 allow the body wall thickness 26 to be maximized along the first and second connection portions 15, 17 compared with pin ends as the first and second connection portions 15, 17 (not shown).

The first and second connection portions 15, 17 may be threaded with a service threading 28 selected to facilitate maximizing the service inside diameter 22 and the body wall thickness 26 within a constraint on the outside diameter 24. The constraint on the outside diameter 24 may be selected to have the outside diameter 24 match the outside diameter of production tubing collars for the production string with which the service tool 10 will be used. The service threading 28 may be selected to facilitate optimizing for connection strength and body wall thickness 26 to provide a service tool 10 suitable for use with production tubing having a given size of API interference fit threading. The service threading 28 may have greater connection strength and body wall thickness 26, while maintaining the constraints on the service inside diameter 22 and the outside diameter 24, compared with using the given size of API interference fit threading on the first and second connection portions 15, 17.

The service threading 28 may be tapered, such as with an API interference fit thread, and may have an external upset end. However, such service threading 28 may be distinct from and incompatible with API interference fit threading. As shown above in Tables 1 and 2, the service inside diameter 22 may be equal to the outside diameter of production tubing 52 joints with which the service tool 10 is to be used, which would not allow for preparing a box-end API connection with the service inside diameter 22. The service threading 28 may have a pitch of 8 or 10, and may be round, v-thread, Acme, or stub-Acme threading, or any suitable type of threading. Such threading may be used for connections between the service tool 10 and connection adapters 30, allowing communication between the service tool 10 and production tubing 52 with API interference fit thread sizes of between about 2.375" and about 4.5".

The connection adapter 30 may be used to connect the service tool 10 with the tubing collar 57, the PCP stator 54, or any suitable box-end tubular, that is threaded other than with the service threading 28. In FIGS. 2 to 5, the connection adapters 30 are shown connecting the service tool 10 with the tubing collar 57, and the service tool 10 with the PCP stator 54. The connection adapter 30 extends between a production string end 32 and an adapter end 34. A production string connection portion 33 extends inward along a length of the connection adapter 30 from the production string end 32. An adapter connection portion 35 extends inward along a length of the connection adapter 30 from the adapter end 34. The production string connection portion 33 defines a pin end for connecting with the production string 50 at the tubing collar 57, the PCP stator 54, or any suitable box end. The adapter connection portion 35 defines a pin end for connecting with the first connection portion 15 or the second connection portion 17.

The production string connection portion 33 may be threaded with production string threading 31 that matches other threading used in the production string 50 (e.g. API interference fit threading on the production tubing 52, the PCP stator 54, and a tubing collar 57, etc.). The adapter connection portion 35 may be threaded with the service threading 28.

A production end inside diameter 36 may be defined along the production string connection portion 33. The production end inside diameter 36 may be similar to the production string inside diameter 55 found in the production tubing 52 or PCP stator 54 used with the service tool 10. When connecting a pin-pin connection adapter 30 (as shown) with pin-pin production tubing 52, the production string connection portion 33 may be threaded into the tubing collar 57. The production string connection portion 33 may be a box end (not shown) to facilitate connection with a pin end joint of production tubing, rather than with the tubing collar 57.

An adapter end inside diameter 37 may be defined along the adapter connection portion 35. The adapter end inside diameter 37 may be greater than the production side inside diameter 36 and may be sufficient to accommodate the PCP rotor 64 and the coiled tubing string 70. The adapter end inside diameter 37 may be substantially equal to the service inside diameter 22 as shown, extending the service portion 25 along the adapter connection portion 35 and continuous with the rest of the production string 50 from the production string connection portion 33 through to the production string 50. In addition, in cases where the service tool 10 is assembled on a rig, the box-box arrangement of the body 12 may mitigate confusion of the body 12 with a pup joint or with a production tubing joint 52 for a longer body 12. Similarly, the pin-pin arrangement of the connection adapter 30 may mitigate confusion of the connection adapter 30 with a connector 57.

The adapter connection portion 35 may include a box-end connection with the service threading 28 for connecting with a service tool having a pin end (not shown). However, maximizing the body wall thickness 26 along the first and second connection portions 15, 17 while maintaining the service inside diameter 22 and a limit on the outside diameter 24 is facilitated where the first and second connection portions 15, 17 are box end connections rather than pin end connections. The required body wall thickness 26 to maintain the integrity of the service tool 10 and its connections with the production string 50 will depend on the material used to prepare the body 12. Where the body 12 is prepared from L-80 high-alloy steel, integrity and connections with the production string 50 will be maintained at a lower body wall thickness 26 along the first and second connection portions 15, 17 than if the body 12 were prepared with J-55 low-carbon steel.

J-55 low-carbon steel is a lower-cost material than L-80 high-carbon steel, as is often the case with weaker grades of steel compared with stronger grades of steel. As a result, the body 12, which is larger than the connection adapter 30, may be prepared with box end first and second connection portions 15, 17, and the connection adapter 30 may be prepared with pin end first and second adapter connection portions 33, 35. This may facilitate preparing the larger connection tool 10 from a lower-cost material (e.g. J-55 low-carbon steel), and preparing the smaller connection adapter 30 from a higher-cost material (e.g. L-80 high-carbon steel), while maintaining adequate body wall thickness 26 and adapter wall thickness 39. All else being equal, pin ends are thinner than box ends, meaning that for a given set of constraints including service inside diameter 22 and maximum outside diameter 24, less body wall thickness 26 will be available as a design consideration when engineering pin ends compared with box ends. The connection adapter 30 is a smaller component than the body 12 and can be manufactured from a higher cost material more cost effectively than the body 12. Based on at least this, an economic advantage may be provided by using having box ends on the body 12, which is larger than the connection adapter 30, because lower-cost materials may be used to manufacture the body 12 relative to manufacturing the connection adapter 30. Alternatively, where differing materials are not necessary, for the same constraints on service inside diameter 22 and maximum outside diameter 24, a stronger connection may be maintained by maximizing the strength of the body 12 and of the connection adapter 30.

Body Sub-Assemblies

Figure 8:
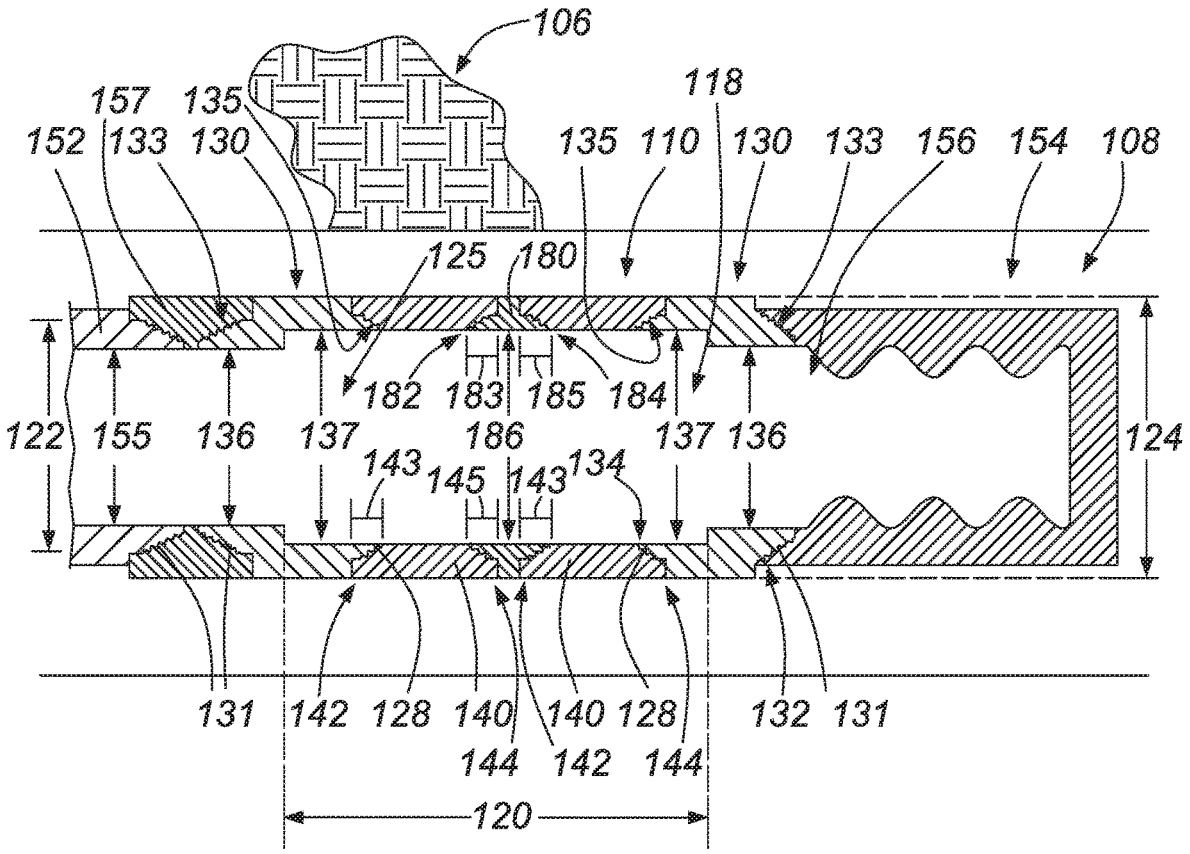
FIG. 8 is a detail view of a service tool in a production string.

FIG. 8 shows a service tool 110 in which the body 112 may be assembled from two or more individual sub-assemblies 140, providing flexibility to accommodate PCP rotors or other large features of different lengths using a group of sub-assemblies 140 for assembling the service tool 110. The sub-assemblies may be prepared in various lengths (e.g. 5', 10', 20', 30', etc.), facilitating assembly of the body 112 at a selected length for use with a particular production string and rod string, and the corresponding PCP rotor or other large feature. The sub-assemblies 140 may be connected using one or more sub connectors 180 threaded with the service threading 128. Use of the service threading 128 to connect the sub-assemblies 140 and the sub connectors 180 may facilitate maximizing the service inside diameter 122 along the bore 118, extending along the service length 120 across the sub-assemblies 140 and through the sub connectors 180. The sub-assemblies 140 and the sub connectors may share a common inside diameter 122 along the service length 122 of the service portion 125 of the bore 118. More than two sub-assemblies 140 may be connected using additional sub connectors 180. The service tool 110 may be assembled from any suitable number of sub-assemblies 140 and sub connectors 180, with the adapter connectors 130 being connected with the outermost two sub-assemblies 140 on each end of the body 112.

Each sub-assembly 140 extends between a first sub end 142 and a second sub end 144. A first sub connection portion 143 extends inwardly along the sub-assembly 140 from the first sub end 142. A second sub connection portion 145 extends inwardly along the sub-assembly 140 from the second sub end 144. The first and second sub connection portions 143, 145 each define a box end of the sub-assembly 140 on which the first and second sub connection portions 143, 145 are located.

The sub connector 180 is used to connect individual sub-assemblies 140 into the tool body 112. The bore 118 extends through the sub-assemblies 140, the sub connectors 180, and the connection adapters 130. The sub connector 180 extends between a first connector end 182 and a second connector end 184. A first sub connector portion 183 extends inwardly from the first connector end 182. A second sub connector portion 185 extends inwardly from the second connector end 184. Each of the first and second sub connectors portions 183, 184 defines a pin end for connecting with a corresponding box end, as is present at each sub connection portion 143, 145. Essentially, the sub connector 180 plays a similar role to the connection adapters 130 as between sub-assemblies 140. The sub connectors 180 differ from the connection adapters 130 in that the sub connectors include the service threading 128 on both first and second sub connectors portions 183, 184, and maintain a single sub connector inside diameter 186 throughout of the bore 118 along the sub connector 180. The sub connector inside diameter 186 may be substantially equal to the inside diameter 122.

Location in the Production String

The service tool 10 may also be included at other portions of a production string where additional inside diameter may facilitate servicing, prolong life of the production string, or provide other features. The service portion 25 may be located to provide the service inside diameter 22 along a portion of the wellbore 6 where rod wear on the production string 50 from the rod string 60 is exacerbated, as illustrated by the examples below. The greater clearance between the rod string 60 and the production string 50 provided by the service portion 25 may mitigate damage to production string 50 (at the service tool 10), to the rod string 60, or both, by reducing the pressure between the rod string 60 and the production string 50.

Figure 9:
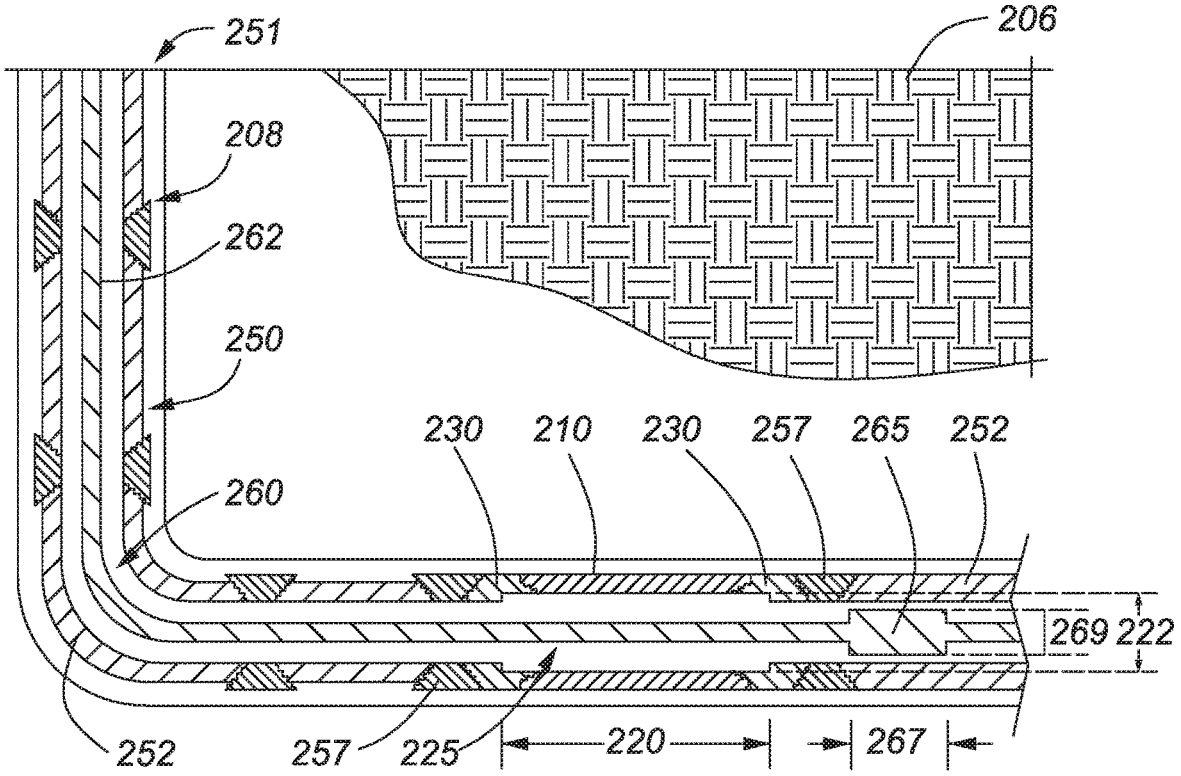
FIG. 9 is a cross-section elevation view of a service tool in a production string.
Figure 10:
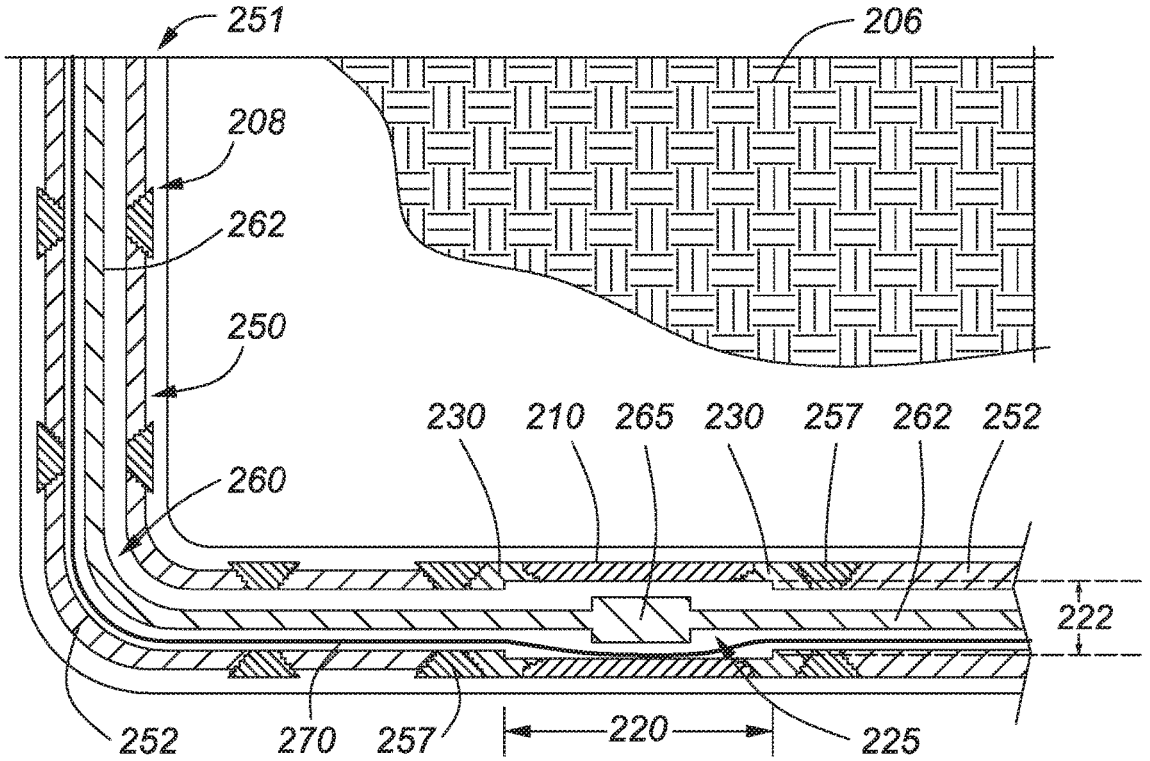
FIG. 10 is a cross-section elevation view of the production string of FIG. 9 with a large feature of a rod string pulled uphole into the service tool and a coiled tubing passing the large feature.

FIGS. 9 and 10 show a production string 250 wherein the service tool 210 is located uphole of a large feature 265 located on the rod string 260. In FIG. 9, the large feature 265 is in a production position, as when hydrocarbons are being produced from the formation 206. In FIG. 10, the large feature 265 is pulled uphole into the service tool 210, and service string 270 is passing the large feature 265. The large feature 265 has an outside diameter 269, major outside diameter, or other outside dimension of the large feature 265 too large to allow the coiled tubing 270 to pass the large feature 265 in the production tubing 252 when the large feature 265 is in the production position. The service inside diameter 222 is sufficient to allow the service string 270 to pass the large feature 265 within the bore 218 of the service tool 210 along the service length 220 of the service zone 225. The large feature 265 has a large feature length 267. The service length 220 is sufficient to accommodate the entire large feature length 267 of the large feature 265.

Figure 11:
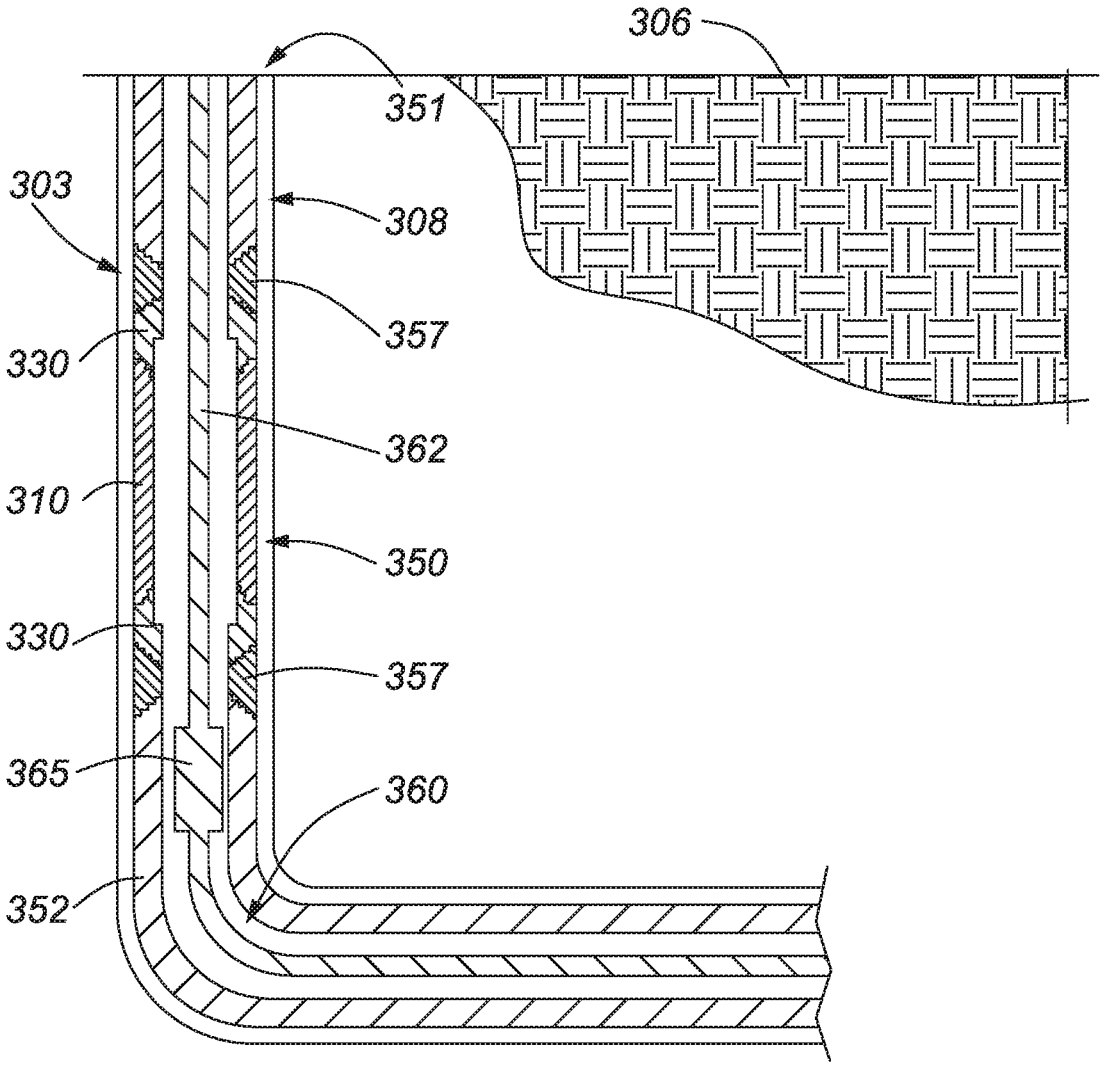
FIG. 11 is a cross-section elevation view of a service tool in a production string.

FIG. 11 shows a production string 350 wherein the large feature 365 is located in a vertical portion 303 of the well bore 308 and the corresponding production string 350. The large feature 365 may be a centralizer, a rod collar, or other large feature. A centralizer may be located in a position of greater rod wear on the rod 362, and the features of the production string 350 and the production string 550 (see FIG. 13 below) may coincide in some cases in that a centralizer may be present in a deviated portion of a wellbore, where rod wear may be expected to be exacerbated.

Figure 12:
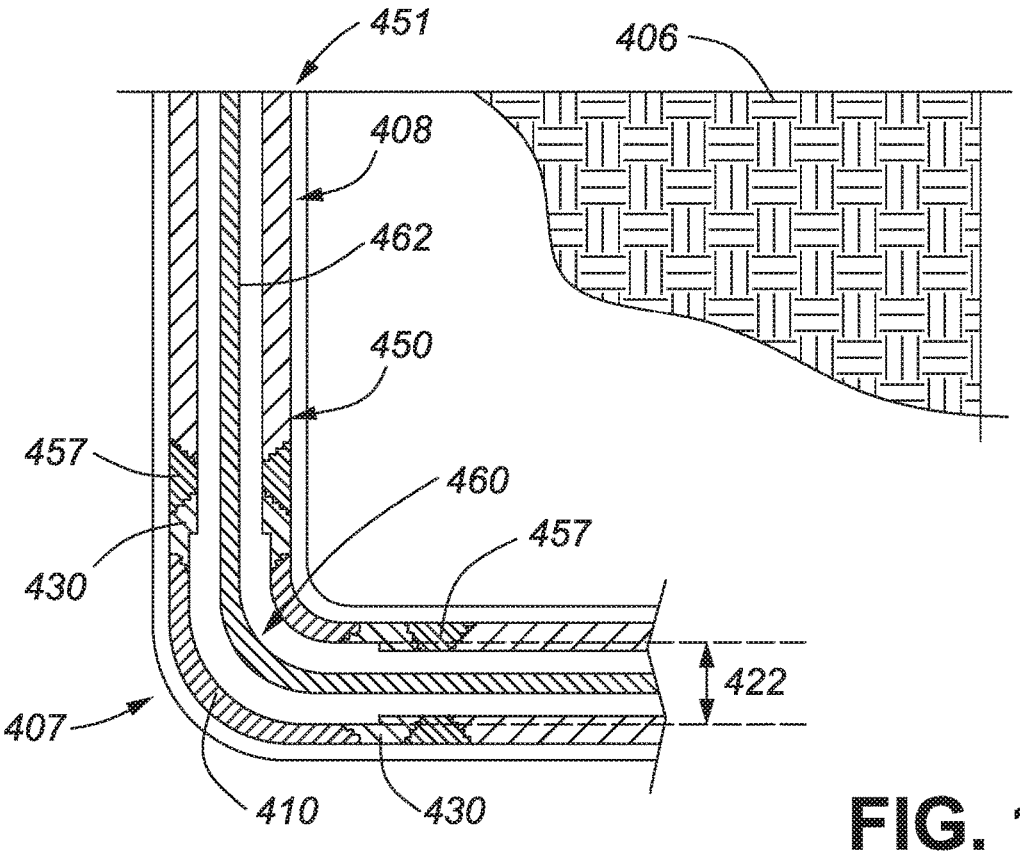
FIG. 12 is a cross-section elevation view of a service tool in a production string.

FIG. 12 shows a production string 450 wherein the service tool 410 is located in a heel 407 of the wellbore 408. The rod 462 has more clearance from the inside diameter in in the service tool 410 than in the production tubing 452 because the service inside diameter 422 is greater than the diameter 455, which may mitigate rod wear resulting from rotation of the rod 462 during production. Further, as shown in this example embodiment, service inside diameter 422 of service tool 410 is greater than an inside diameter of the rest of production string 450. In this sense, service tool 410 is an increased inside diameter (ID) portion of production string 450. It can be seen in this embodiment that service inside diameter 422 of service tool 410 is greater than an inside diameter of production string 450 along at least half of the length of production string 450 other than at service tool 410.

Figure 13:
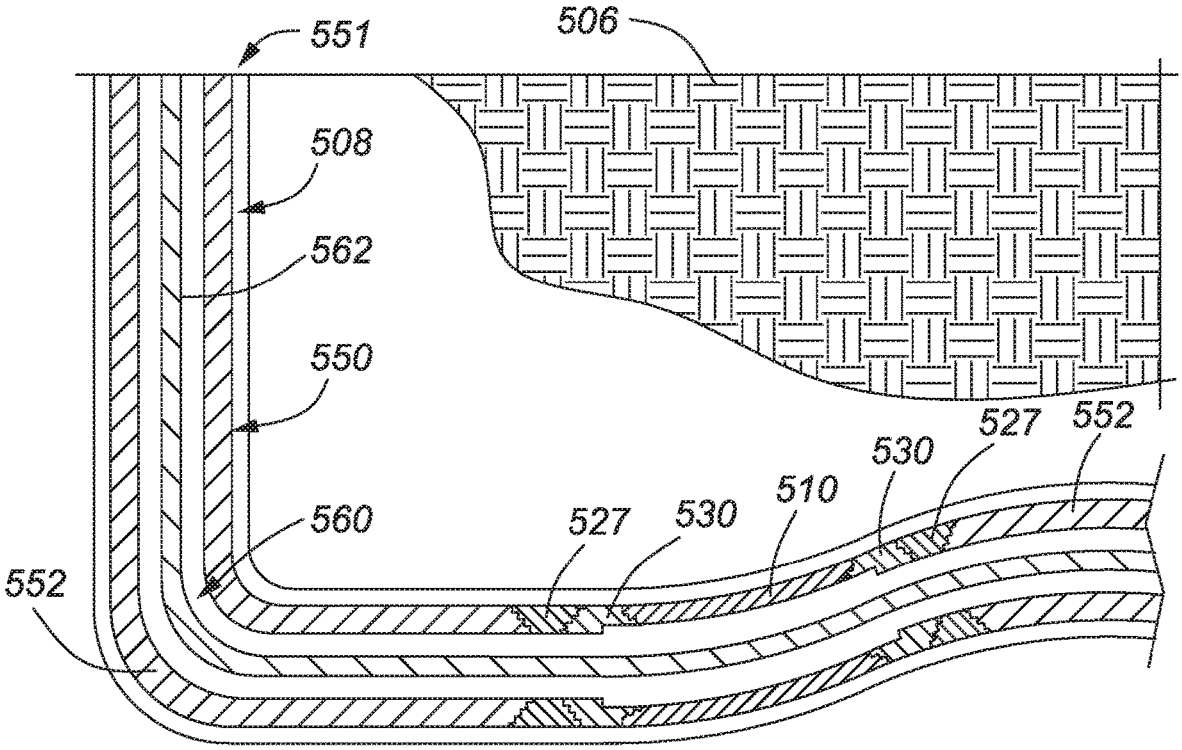
FIG. 13 is a cross-section elevation view of a service tool in a production string.

FIG. 13 shows a production string 550 wherein the service tool 510 is located in a deviated portion 509 of the wellbore 508. Similarly to the heel 407 in the wellbore 408, the additional clearance in the service tool 510 compared with the production tubing 552 due to the greater inside diameter 522 compared with the inside diameter 555 may mitigate rod wear resulting from rotation of the rod 562 during production. Such rod wear may be aggravated in portions of a wellbore where a horizontal rod string will fall, or where a vertical rod string will press against one side of the production tubing.

Other Service Tool Features

The service tool 10 may be prepared from hardened steel to prevent wear from the PCP rotor 64 or other components of the rod string 60 during close clearance with the service string 70. A hardened inside surface of the service tool would also provide advantages in production strings where the service tool 10 is located in a region of the wellbore having an increased tendency for rod wear (e.g. see the production strings 450, 550 in FIGS. 12 and 13). The service tool may include a hardened inner coating of 70 to 80 Rockwell C material on a portion of a body made of J-55 steel, or could have a portion of the body hardened (e.g. through boranizing, etc.). This approach would protect the service tool from damage due to rod wear.

Figure 14:
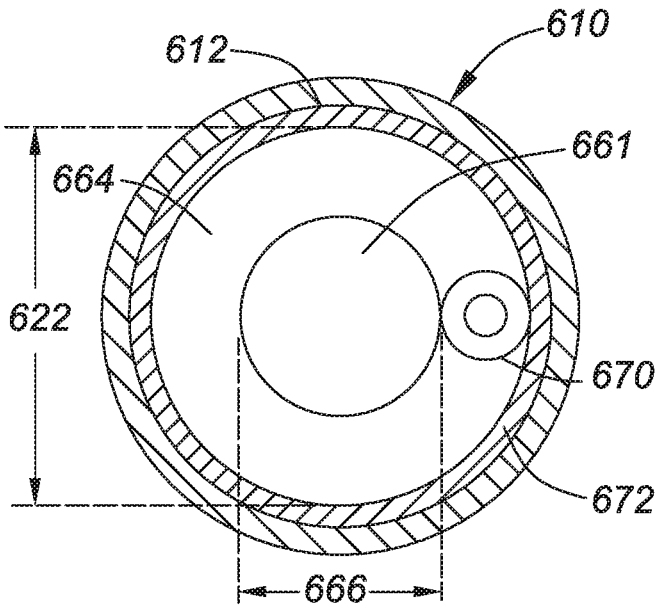
FIG. 14 is a cross section plan view of a rod coupling in a service tool having a low-wear insert in the service portion.

FIG. 14 shows a rod coupling 661 in a service tool 610 having a low-wear insert 672 located in the service portion 625. The rod coupling has a diameter 666. The service string 670 is also included showing clearance between the rod coupling 661 and the low-wear insert 672. The low-wear insert 672 may mitigate damage to both the rod string 660 and the service tool 610. The low-wear insert 672 may for example include an HDPE liner, rubber liner, or any suitable liner. The greater inside diameter of about 3.8" shown in Table 2 may facilitate use of the HDPE liner in a service tool 610 while maximizing the service inside diameter 622.

Figure 15:
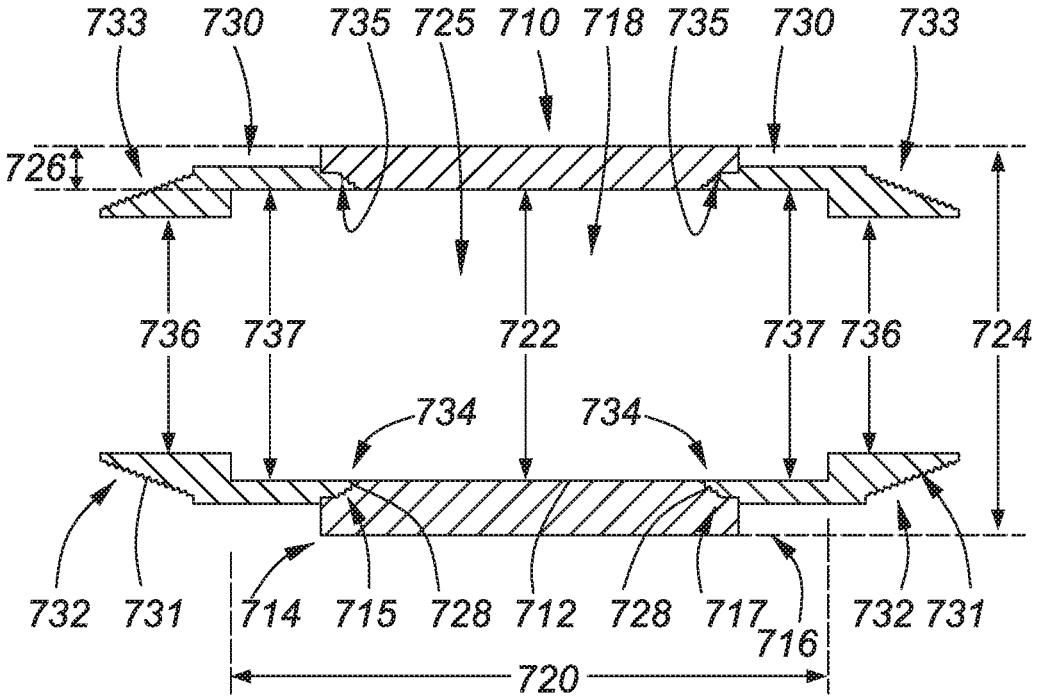
FIG. 15 is a cross-section elevation view of a service tool having differing outside diameters.

FIG. 15 shows a service tool 710 having differing outside diameters on the body 712 as compared with the connection adapters 730. In the service tool 10, the maximum outside diameter 24 is shared along the body 12 and the connection adapters 30. In the service tool 710, the body wall thickness 726 is greater than the adapter wall thickness 739. As a result, along the adapter end inside diameter 737 of the connection adapters 730, the adapter wall thickness 739 is lowered.

Figure 16:
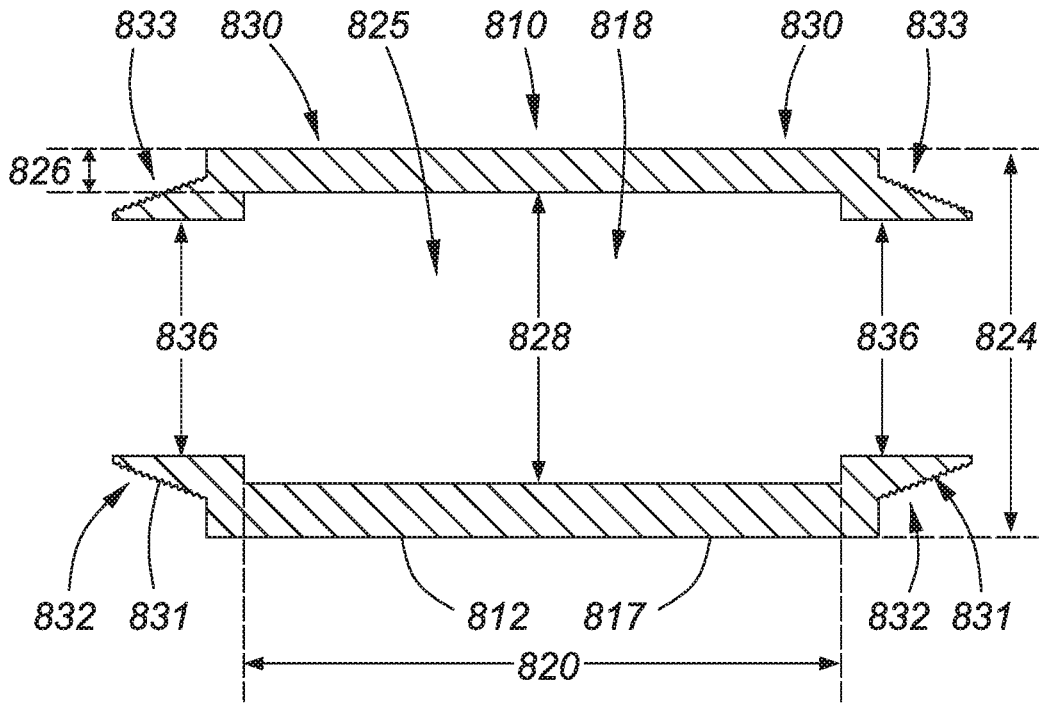
FIG. 16 is a cross-section elevation view of a service tool having a unitary design.

FIG. 16 shows a service tool 810 having a unitary design of the body 812 and connection adapters 830. The service tool 810 includes connection adapters 830 that are integral with the body 812. The inside diameter of the bore 818 changes from the service inside diameter 820 to the production end inside diameter 836 at a portion of the service tool 810 coextensive with at least a portion of the production string threading 831 on the production string connection portion 833.

Figure 17:
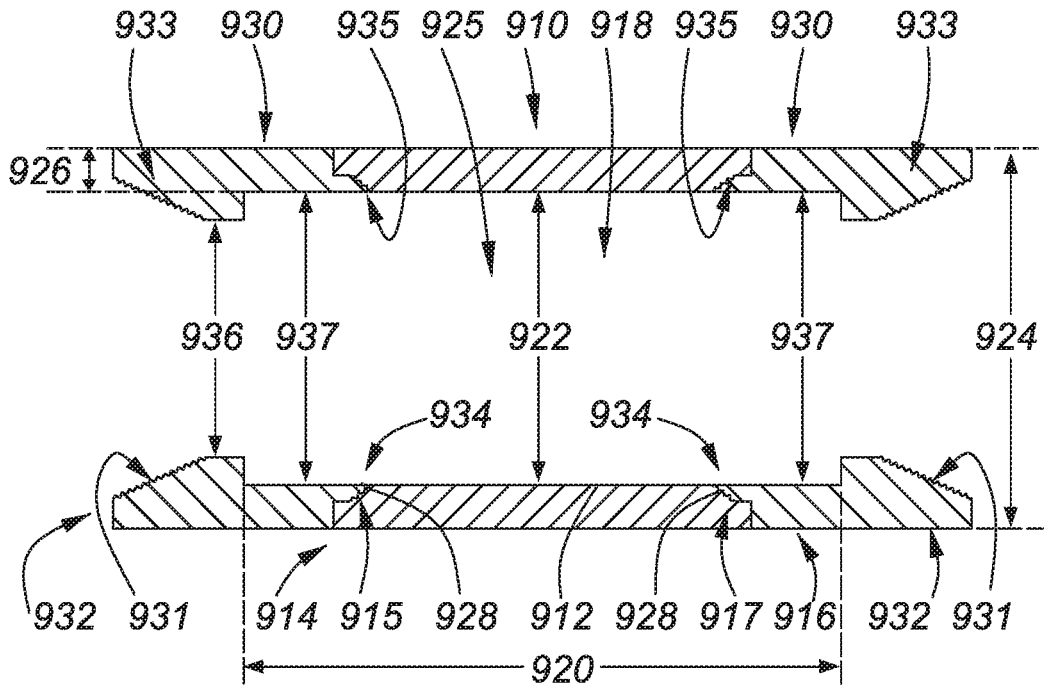
FIG. 17 is a cross-section elevation view of a service tool with alternative connection adapters.

FIG. 17 shows a service tool 910 having box-end interference fit connection on the production string ends 932. The box-end allows use of the service tool 910 with a pin end of the a production tubing joint rather than with a production tubing connector. A gripping surface for power tongs long enough for tong dies may also be provided on the connection adapter 30, facilitating assembly of the connection adapter 30 with the service tool 10 or with the production string 50 on a rig.

Figure 18:
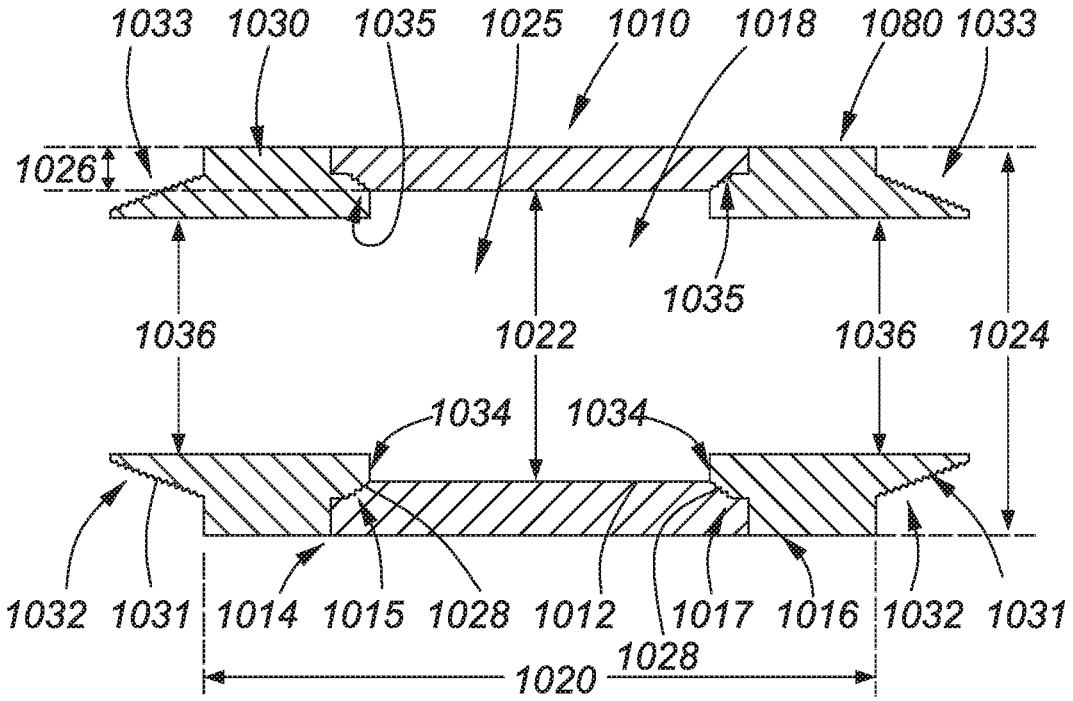
FIG. 18 is a cross-section elevation view of a service tool with alternative inside diameters.

FIG. 18 shows a service tool 1010 in which the connection adapters 1030 have the production end inside diameter 1036 along the entire bore 1018 within the connection adapters. The service portion 1025 extends along only the body 1012 and not through the connection adapters 1030. The service tool 1010 may provide facilitate greater wall thickness at the connection adapters 1030.

Figure 19:
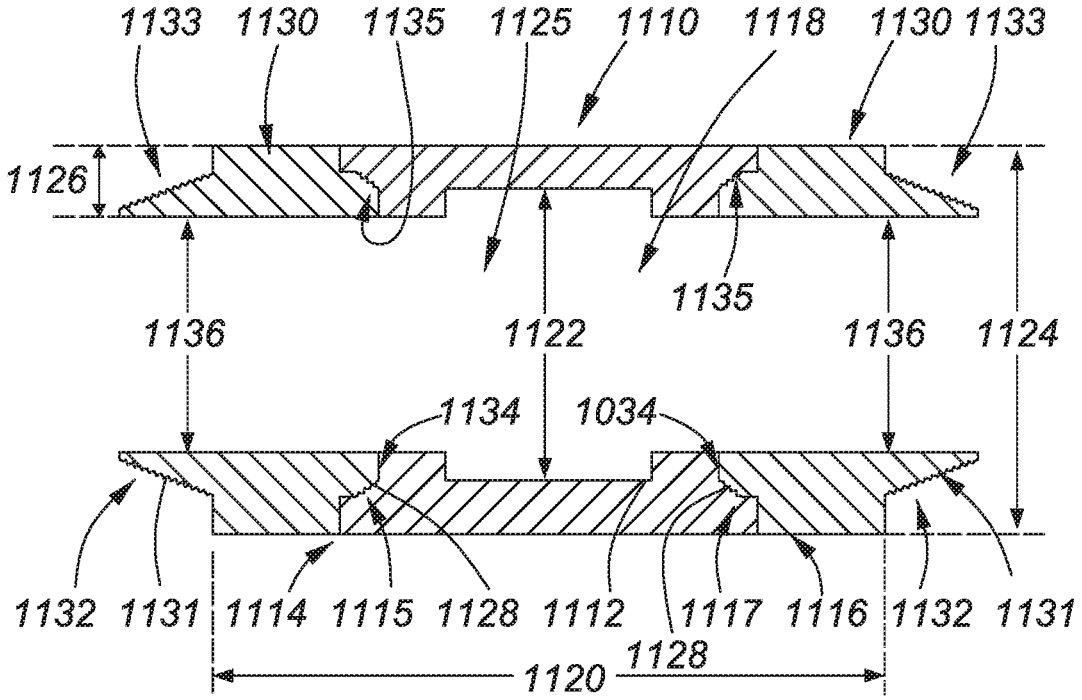
FIG. 19 is a cross-section elevation view of a service tool with alternative inside diameters.

FIG. 19 shows a service tool 1110 in which the body 1112 defines a reduced inside diameter portion 1121. The reduced inside diameter portion 1121 may have an inside diameter similar to that of production tubing with which the service tool 1110 is to be used. The service portion 1125 and the service length 1120 are defined by the bore 1118 along the body 1112 where the service inside diameter 1122 is present.

Examples Only

In the preceding description, for purposes of explanation, numerous details are set forth in order to provide a thorough understanding of the embodiments. However, it will be apparent to one skilled in the art that these specific details are not required.

The above-described embodiments are intended to be examples only. Alterations, modifications and variations can be effected to the particular embodiments by those of skill in the art. The scope of the claims should not be limited by the particular embodiments set forth herein, but should be construed in a manner consistent with the specification as a whole.

What is claimed is:

1. A method of completing a well comprising:

providing a production string extending between a downhole end and an uphole end; and providing an increased inside diameter ("ID") portion of the production string at a selected location in the production string for mitigating rod wear on the production string at the selected location caused by a rod string when the rod string is located within the production string, wherein an ID of the increased ID portion is greater than an ID of the production string along at least half of the length of the production string other than at the increased ID portion, thereby providing for an increased clearance between an ID surface of the production string and an outside diameter ("OD") surface of the rod string at the increased ID portion relative to an ID surface of the production string and an OD surface of the rod string at the at least half of the total length of the production string.

2. The method of claim 1 wherein the selected location is in a deviated portion of the wellbore.

3. The method of claim 1 wherein the selected location is in a heel of the wellbore.

4. The method of claim 1 wherein the increased ID portion of the production string has a hardness of about 80 Rockwell C.

5. The method of claim 1 wherein the increased ID portion of the production string is hardened by boranizing or applying a coating to the increased ID portion.

6. The method of claim 1 wherein the production string comprises a low wear insert along at least a portion of the increased ID portion of the production string.

7. The method of claim 1 wherein the production string other than the increased ID portion comprises joints of production tubing and collars connecting the joints.

8. The method of claim 7 wherein:

the production tubing has an OD of about 3.5";

the production tubing has an ID of about 3.0";

the collars have an OD of about 4.5";

the increased ID portion has an ID of about 3.5"; and the increased ID portion has an OD of about 4.5".

9. The method of claim 7 wherein:

the production tubing has an OD of about 4.5";

the production tubing has an ID of about 4.0";

the collars have an OD of about 5.5";

the increased ID portion has an ID of about 4.5"; and the increased ID portion has an OD of about 5.5".

* * * * *